United States Patent [19]

Titus

[11] 4,311,235

[45] Jan. 19, 1982

[54] ORGANIZER JEWELRY BOX

[76] Inventor: Wanda L. Titus, Box 1212, Black Canyon Stage, Phoenix, Ariz. 85029

[21] Appl. No.: 135,682

[22] Filed: Mar. 31, 1980

[51] Int. Cl.[3] ..... B65D 73/00; B65D 1/34

[52] U.S. Cl. ..... 206/483; 206/560; 206/564; 206/566

[58] Field of Search ..... 206/566, 509, 503, 560, 206/564, 483

[56] References Cited

U.S. PATENT DOCUMENTS

| | | | |
|---|---|---|---|
| D. 219,955 | 2/1971 | Seaman | 206/566 |
| 508,700 | 11/1893 | Gruebel | 206/566 |
| 1,496,542 | 6/1924 | Jersemann | 206/566 |
| 1,528,229 | 3/1925 | Wetherell | 206/566 |
| 2,739,697 | 3/1956 | Kuddes | 206/566 |
| 2,883,048 | 4/1959 | Lentz | 206/566 |
| 3,191,791 | 6/1965 | Jackson | 206/564 |
| 3,337,047 | 8/1967 | Otis et al. | 206/564 |
| 3,578,158 | 5/1971 | Aylott | 206/509 |

FOREIGN PATENT DOCUMENTS

| | | | |
|---|---|---|---|
| 2163716 | 6/1973 | Fed. Rep. of Germany | 206/566 |
| 343281 | 1/1960 | Switzerland | 206/566 |

*Primary Examiner*—Joseph Man-Fu Moy
*Attorney, Agent, or Firm*—Gregory J. Nelson

[57] ABSTRACT

An organizer jewelry tray for an organized containment of earrings for pierced ears. The tray surface defines an organizer section having a recess with a pair of projecting pins or posts for receiving the clasp portion of the pin. An adjacent land defines apertures for receiving the post portion of the decorative body of the earring. The edge of the tray is configured having a lip so a plurality of trays may be vertically stacked. The tray may be variously configured, for example, having a square, rectangular or circular shape.

6 Claims, 6 Drawing Figures

ORGANIZER JEWELRY BOX

The present invention relates to a container and more particularly relates to a jewelry box of the type particularly adapted to receive and contain earrings in an organized manner.

It is fashionable for women to wear jewelry as items of adornment. Earrings, particularly the type suitable for use with pierced ears are particularly popular as jewelry items. It is common that an individual has a large selection of earrings of various designs, materials and sizes to coordinate with the clothes of the wearer as an article of personal adornment. Since earrings of this type are often quite small, they may be easily lost, misplaced or difficult to recover if simply stored in a conventional jewelry box.

Several specialized jewelry boxes or trays to accommodate earrings of this type can be found in the prior art. For example, U.S. Pat. No. 4,023,674 discloses a jewelry box having a removable lid with two apertures through which the posts of a pair of earrings can be placed with the earring clasp attached to the post on the underside of the lid. The earrings are removed for use. While this box provides a convenient structure for storing earrings of this type, only a single pair can be accommodated. Further, it is necessary to remove the lid and remove the clasps to extricate the earring post from the cover.

A somewhat similar package or container is shown in U.S. Pat. No. 4,043,449 which discloses a box containing a greeting card which is perforated to receive the posts of one or more pairs of earrings. Again, the functional usefulness of this design is somewhat limited making the removal of the earrings difficult.

Accordingly, there exists a need for an organizer type of jewelry box especially adapted for the organized containment of earrings for pierced ears and other articles of jewelry. In accordance with the foregoing requirements, the present invention provides an organizer jewelry box of the general type which is particularly convenient and aesthetically appealing. The organizer jewelry box of the present invention comprises a tray structure having a plurality of recesses and adjacent lands formed in the upper surface of the tray. A pair of upwardly extending posts or projections for receipt of the decorative portion of the earring are associated with each recess. The raised land portions each define a pair of apertures for receipt of the pin or post portion of earrings. Thus, a pair of earrings can be positioned in the recess and land members in an organized fashion. The peripheral edge of the tray defines a lip for receipt of a cover or so a plurality of trays can be vertically stacked in interlocking, frictional engagement. Additional compartments may also be formed in the tray surface for containment of other items.

The above and other objects in advantage of the present invention will be more fully appreciated from the following description, claims and drawings in which:

Figure 1:
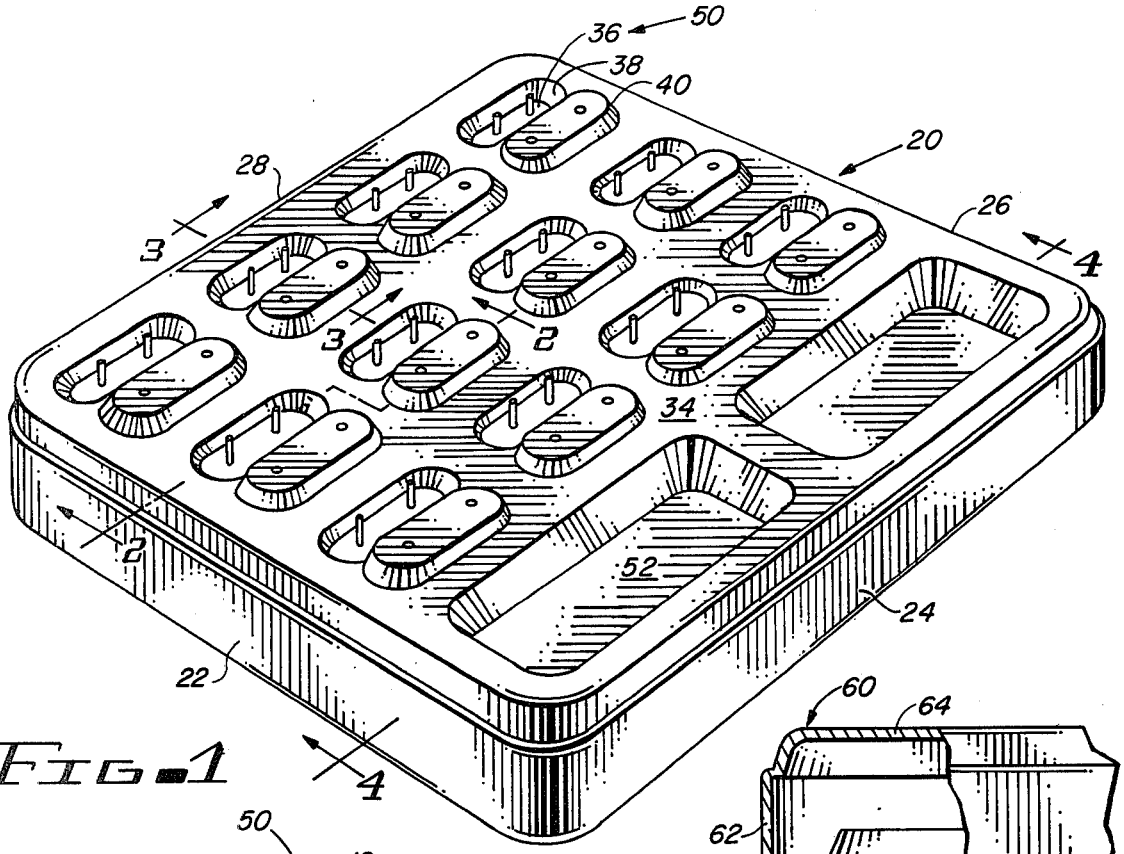
FIG. 1 is a perspective view of the tray of the present invention.
Figure 2:
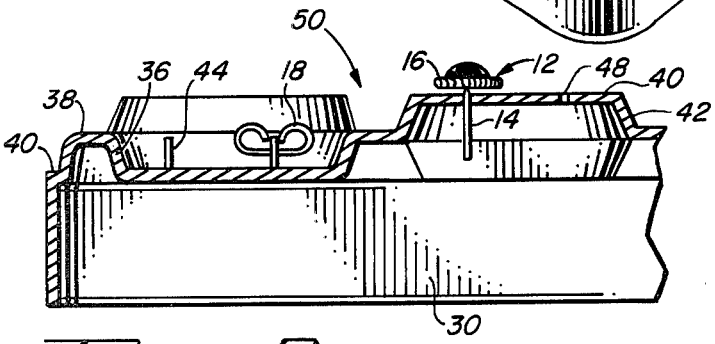
FIG. 2 is a sectional view taken along lines 2—2 of FIG. 1.

Turning now to the drawings, there is shown a tray generally designated by the numeral 20 which is particularly suitable for the organized containment of earrings for pierced ears. As seen in FIG. 2, earrings 12 of this type, are of well known instruction and include an elongate pin or post member 14 having a pointed end which extends through the ear of the wearer. An ornamental or decorative portion 16 is secured at the upper end of the pin or post 14. Earring 12 is secured in place by a clasp member 18 which is received on the post at the back of the ear lobe of the wearer. It is to be understood that the general form of the earring described above is for the purpose of illustration, and earrings of this type are well known in the art.

A tray 20 may be formed of any suitable material and is preferably vacuum formed or injection molded from a suitable plastic material such as ABS. Tray 20, as shown in FIGS. 1 to 4, is generally rectangular having upstanding sidewalls 22, 24, 26 and 28. The upstanding tray sides define an open bottom 30 which facilitates stacking of trays as will be more fully explained hereafter.

A generally horizontal surface 34 extends between the upstanding sidewalls 22, 24, 26 and 28 and has a peripheral edge 38 inwardly spaced from the sidewalls 22, 24, 26 and 28 forming a horizontal lip or edge 40 which provides frictional engagement between the trays in a stacked position as will be explained.

The upper tray surface 34 defines means for the organized reception of earrings preferably arranged in an aesthetically pleasing and convenient manner. Tray surface 34 defines a plurality of organizer sections 50 including generally elongate recesses 36 which are relatively shallow shown as having circular ends 38 and adjacent lands 40. The particular shape of the recess 36 may vary. The elongate shape is shown for purposes of representation as it is aesthetically pleasing.

A pair of projections 44 are positioned in side by side relationship within the recess 36. The projections 44, in the form of pins or posts, are adapted to receive the clasp 18 of the earring. Immediately adjacent the recess 36 is a raised land portion 40 of similar shape having a peripheral upstanding wall 42. Raised land portion 40 is provided with a pair of apertures 48 dimensioned to facilitate insertion of the post or pin 14 of the earring 12. Preferably, the apertures 48 and projections 44 are in an aligned relationship as shown. As pointed out above, any convenient number and arrangement of organizer sections 50 may be provided in the upper surface 34 of the tray.

In addition, one or more recessed compartments 52 may also be provided at a suitable location to the tray surface 34 for reception of additional articles of jewelry or other items such as larger earrings which may not be accommodated in the apertures and on the posts.

The earrings are stored in the tray 20 as best shown in FIG. 2. Clasps 18 for a pair of earrings are positioned over the upstanding projections 44 and are thus held in a convenient position for removal when used. Note the upstanding posts 44 do not project above the plane of surface 34 so no obstruction is presented. Further, should the clasps 18 become dislodged from the projection, they will most likely remain within the recess 36 so the possibility of loss in the event of dislodgement is minimized. The cooperative, decorative and pin portion of the earrings are placed on the adjacent land 40 by inserting the post 14 of the earrings in the apertures 48. Thus, each pair of earrings is arranged in its organizer section 50 of the tray in a convenient position. Since the pins 14 project through to the open underside 30 of the tray, possibility of injury from the point to the user is also reduced. Other articles of jewelry such as pins, necklaces and the like, which the user may have can be placed in the compartments 52.

Figure 5:
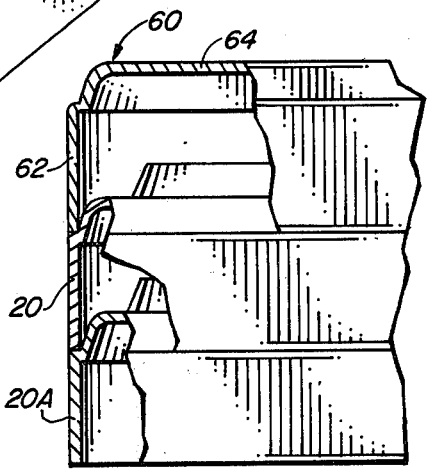
FIG. 5 is a side view, partially broken away, illustrating a plurality of jewelry trays in stacked positions.
Figure 3:
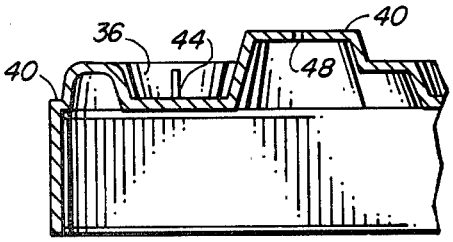
FIG. 3 is a sectional view taken along lines 3—3 of FIG. 1.

For safety and for transportation, a cover 60, as shown in FIG. 5, may be positioned in frictional interfitting engagement with the tray 10. Cover 60 can be formed from any suitable material such as a vacuum formed or injection molded plastic. Cover 60 has a peripheral sidewall 62 conforming in shape and dimensions to sidewalls 22, 24, 26 and 28 of tray 20. Top surface 64 extends between the sidewalls 62. Cover 60 may preferably be transparent or translucent to provide the user with an unobstructive view of the contents of tray 20. Cover 60 is positioned over tray 10, as shown in FIG. 5, be engaging sidewall 62 at edge 38 and lip 40 of tray 10. The cover 60 and tray 20 cooperate with each other in a dimensional interfitting resulting in frictional engagement which secures the cover and tray together. The cover may be removed by application of an upward separation force.

As shown in FIG. 5, a plurality of tray sections 20 can be vertically stacked in a dimensional interfitting relationship as shown. Lower tray 20A can be positioned with its peripheral lip 40 and edge 38 engaged at the bottom and innerside of the peripheral sidewalls 22, 24, 26 and 28 of the upper tray section 20. Any convenient number of trays can be vertically stacked in this manner making a compact and orderly arrangement for containment and storage of earrings and other items.

Figure 6:
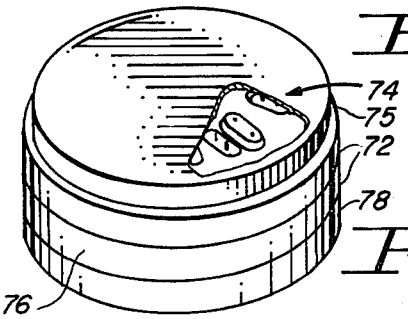
FIG. 6 is a perspective view of an alternate embodiment of the tray of the present invention in a stacked position.
Figure 4:
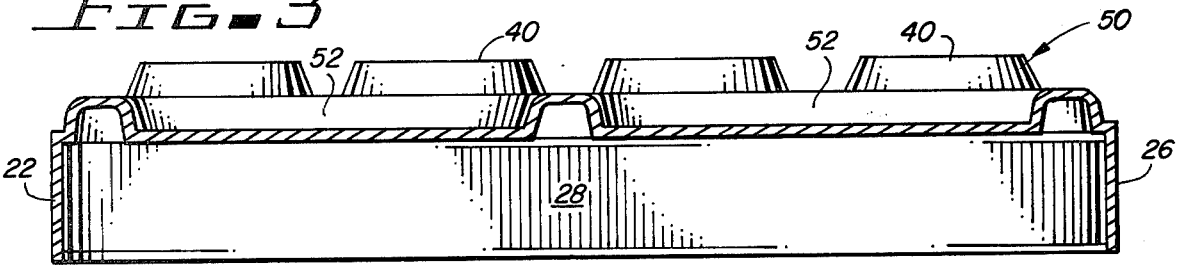
FIG. 4 is a sectional view taken along lines 4—4 of FIG. 1.

FIG. 6 illustrates another embodiment of the present invention which is generally designated by the numeral 70 and comprises a stackable series of trays 72, each having a plurality of organizer sections 74 formed in the top surface 75. Trays 72 are shown as having a circular edge 76 defining a lip 78 at the innersection with the top surface. Lip 78 permits the trays to be stacked as shown. In other respects, trays 72 are as they have been described with reference to previous figures. This embodiment is shown for representation that the embodiment of the present invention may be variously configured and shaped.

Thus, it will be seen from the foregoing that the present invention provides a unique, compact and conveniently manufactured jewelry tray. The tray of the present invention can be manufactured from various materials including plastic by conventional technique such as vacuum forming and injection molding. The tray can be variously configured to meet the aesthetic requirements of the intended user. A plurality of trays can be stacked for compact arrangement. Individual earrings are retained on the tray in an organized, easily accessible and conveniently displayed manner. Provisions are made for organized reception of other articles in the tray surface.

It should be understood that while the preferred embodiment of the present invention has been described herein, various other changes, modifications and alterations will become apparent to those skilled in the art. Accordingly, the scope of the present invention should be defined only by the appending claims and equivalents thereof.

I claim:

1. An organizer tray for the organized containment of jewelry items particularly pairs of earrings for pierced ears having a clasp and an ornamental portion, said tray comprising:

(a) a tray surface supported on and intersecting upstanding sidewalls at a peripheral edge; and (b) an organizer section formed in said tray surface comprising:

(i) recess means defined in said surface, said recess having a bottom wall and a pair of projection means upwardly extending from said bottom wall adapted to receive said clasp portion of a pair of earrings;

(ii) land means formed in said tray adjacent said recess, said land having a surface defining a pair of apertures for receiving the ornamental portion of a pair of earrings.

2. The tray of claim 1 further including a compartment defined in said surface for the containment of jewelry articles.

3. The tray of claim 1 wherein said sidewalls define a generally rectangular tray surface and said recess means and said land means are generally elongate.

4. The tray of claim 1 further including a transparent cover having peripheral sidewalls having adapted to frictionally interfit with said lip.

5. The tray of claim 1 wherein said tray is integrally formed of a plastic material.

6. The tray of claim 1 wherein said peripheral edge defines a lip adapted to have a frictionally interfitting relationship with the said sidewalls of a superjacent tray whereby trays can be vertically stacked.

* * * * *